US006318329B1

(12) United States Patent
Sato

(10) Patent No.: US 6,318,329 B1
(45) Date of Patent: Nov. 20, 2001

(54) VIBRATION DAMPING MOUNT FOR ENGINE CONTROL COMPONENTS

(75) Inventor: Takayuki Sato, Shizuoka (JP)

(73) Assignee: Sanshin Kogyo Kabushiki Kaisha (JP)

( * ) Notice: Subject to any disclaimer, the term of this patent is extended or adjusted under 35 U.S.C. 154(b) by 0 days.

(21) Appl. No.: 09/360,182

(22) Filed: Jul. 23, 1999

(30) Foreign Application Priority Data

Jul. 23, 1998 (JP) ..... 10-207755

(51) Int. Cl.[7] ..... F02B 75/06

(52) U.S. Cl. ..... 123/192.1; 123/195 P; 123/509

(58) Field of Search ..... 123/192.1, 198 R, 123/195 A, 195 E, 195 P, 456, 480, 509; 361/807, 808, 810, 759, 758; 248/560, 638, 640; 267/136, 140.11, 292, 293, 140.12

(56) References Cited

U.S. PATENT DOCUMENTS

| | | | | |
|---|---|---|---|---|
| 4,790,279 | * | 12/1988 | Tobinaga et al. | 123/417 |
| 4,843,520 | | 6/1989 | Nakatani et al. | 361/395 |
| 4,895,120 | * | 1/1990 | Tobinaga et al. | 123/417 |
| 4,933,809 | | 6/1990 | Boede et al. | 361/395 |
| 5,105,334 | | 4/1992 | Holinka | 361/380 |
| 5,394,838 | * | 3/1995 | Changler | 123/25 C |
| 5,706,783 | * | 1/1998 | Sawada | 123/417 |
| 5,989,085 | * | 11/1999 | Suzuki | 440/53 |
| 6,094,984 | * | 8/2000 | Asano et al. | 73/493 |
| 6,155,895 | * | 12/2000 | Sato et al. | 440/88 |
| 6,213,096 | * | 4/2001 | Kato et al. | 123/456 |

FOREIGN PATENT DOCUMENTS

| | | |
|---|---|---|
| 11-59591 | 3/1999 | (JP) . |
| WO 97/48568 | 12/1997 | (WO) . |

* cited by examiner

*Primary Examiner*—Noah P. Kamen
*Assistant Examiner*—Hai Huynh
(74) *Attorney, Agent, or Firm*—Knobbe, Martens, Olson & Bear, LLP

(57) ABSTRACT

A direct injected engine includes a multi-layer support that attaches injector drivers to the engine while substantially isolating the injector drivers from high and low frequency vibrations. One layer of the support is formed of a relatively hard material so as to dampen high frequency vibrations produced by the engine when running at high speeds (e.g., 5300 rpm). A second layer of the support is formed of a softer material so as to dampen low frequency vibrations produced by another electronic control component, such as, for example, an electronic control unit (ECU), which the support also attaches to the engine. The ECU is disposed between the engine and a housing containing the injector drivers. The first layer of the support in this structure substantially isolates both the electronic control unit and the injector drivers from engine vibrations, and the second layer of the support substantially isolates the injector drivers from ECU-produced vibrations.

38 Claims, 5 Drawing Sheets

VIBRATION DAMPING MOUNT FOR ENGINE CONTROL COMPONENTS

BACKGROUND OF THE INVENTION

1. Field of the Invention

The present invention relates to a vibration-damping support mount for attaching control electronics to an engine, and more particularly to a vibration-damping support mount used to attach electrical control components to an engine of an outboard motor.

2. Description of the Related Art

There exists in all fields of engine design an increasing emphasis on obtaining more effective emission control, better fuel economy and, at the same time, continued high or higher power output. This trend has resulted in the substitution of fuel injection systems for carburetors as the engine charge former. In the common systems used, fuel is injected into an intake air manifold. In order to obtain still further improvement, direct injection systems are being considered. These systems inject fuel directly into the combustion chamber and thus have significant potential advantages.

Direct injection, however, means that the pressure into which the fuel is injected is higher than with manifold injection systems in which the pressure is at substantially atmospheric pressure or even below. The fuel system for direct injection thus must supply fuel to the fuel injectors at extremely high pressure in order to inject into the corresponding combustion chambers when near minimum volume (i.e., with the piston near top dead center). The solenoids of the fuel injectors consequently are larger in order to operate the injector valves under the increased fuel pressure.

Larger solenoids, however, require increased voltage and current to properly operate. That is, for direct injected engines, a high voltage (e.g., 100 Volts) is required to drive the solenoids of the fuel injectors as compared to conventional manifold injection systems. Injection drivers are commonly used to develop higher voltages for driving the fuel injector solenoids. Such injector drivers are commonly mounted to the body of the vehicle in automotive applications.

An electronic control unit (ECU) often controls the timing and duration of fuel injection. The ECU thus controls the selective connection of the injector drivers to the fuel injectors so as to operate the injectors in a manner optimizing engine performance and emission control for a given running condition.

SUMMARY OF THE INVENTION

It is advantageous to use automobile injector drivers with outboard motors that employ direct injected engines in order to reduce cost. That is, because injector drivers are readily and commercially available in and are mass produced for the automotive industry, the use of the same injector drivers with outboard motors does not require a specially designed driver that could be amortized only over smaller unit volumes. Application of automotive injector drivers with outboard motors thus reduces the cost of the engine, but this is not without complication.

The injector drivers desirably are mounted on the engine in an outboard motor in order to present a compact arrangement and for safety. This mounting location, however, exposes the injector drivers to engine vibrations which can impair the durability of the injector drivers.

One aspect of the present invention thus provides an improved mounting arrangement of an electrical component (e.g., an injector driver) on an engine. The engine comprises an engine body that defines at least one variable-volume combustion chamber. At least one fuel injector communicates with the combustion chamber, and an electronic control system controls the fuel injector. The electronic control system includes at least one electronic component disposed on a substrate. A multi-layer support couples the substrate to the engine. The support includes at least two of the layers of material that have differing vibration damping effects.

In one mode, the fuel injector directly communicates with the combustion chamber, and the electronic component comprises an injector driver. The electronic control system additionally includes a controller that also is supported on the engine by the support. A first layer of material of the support is disposed between the controller and the engine to generally isolate the controller and the injector driver from engine vibrations, and a second layer of material of the support is disposed between the controller and the injector driver to generally isolate the injector driver from vibrations produced by the controller. For this purpose, the first layer of material is harder than the second layer to absorb higher frequency vibrations produced by engine operation, especially when operated under a wide-open running condition. The second layer is softer to absorb lower frequency vibrations produced by the controller.

Further aspects, features, and advantages of the present invention will become apparent from the detailed description of the preferred embodiments which follow.

BRIEF DESCRIPTION OF THE DRAWINGS

The above-mentioned and other features of the invention will now be described with reference to the drawings of preferred embodiments of the present watercraft. The illustrated embodiments are intended to illustrate, but not to limit the invention. The drawings contain the following figures.

DETAILED DESCRIPTION OF THE PREFERRED EMBODIMENT

The general overall environment in which the invention is practiced and certain details of the engines will be described primarily by reference to FIGS. 1–3 and additionally to FIG. 4; however, it should be understood that the following description of the invention in the context of an outboard motor is merely exemplary of one application in which the invention can be employed, as one skilled in the art will readily appreciate.

Figure 1:
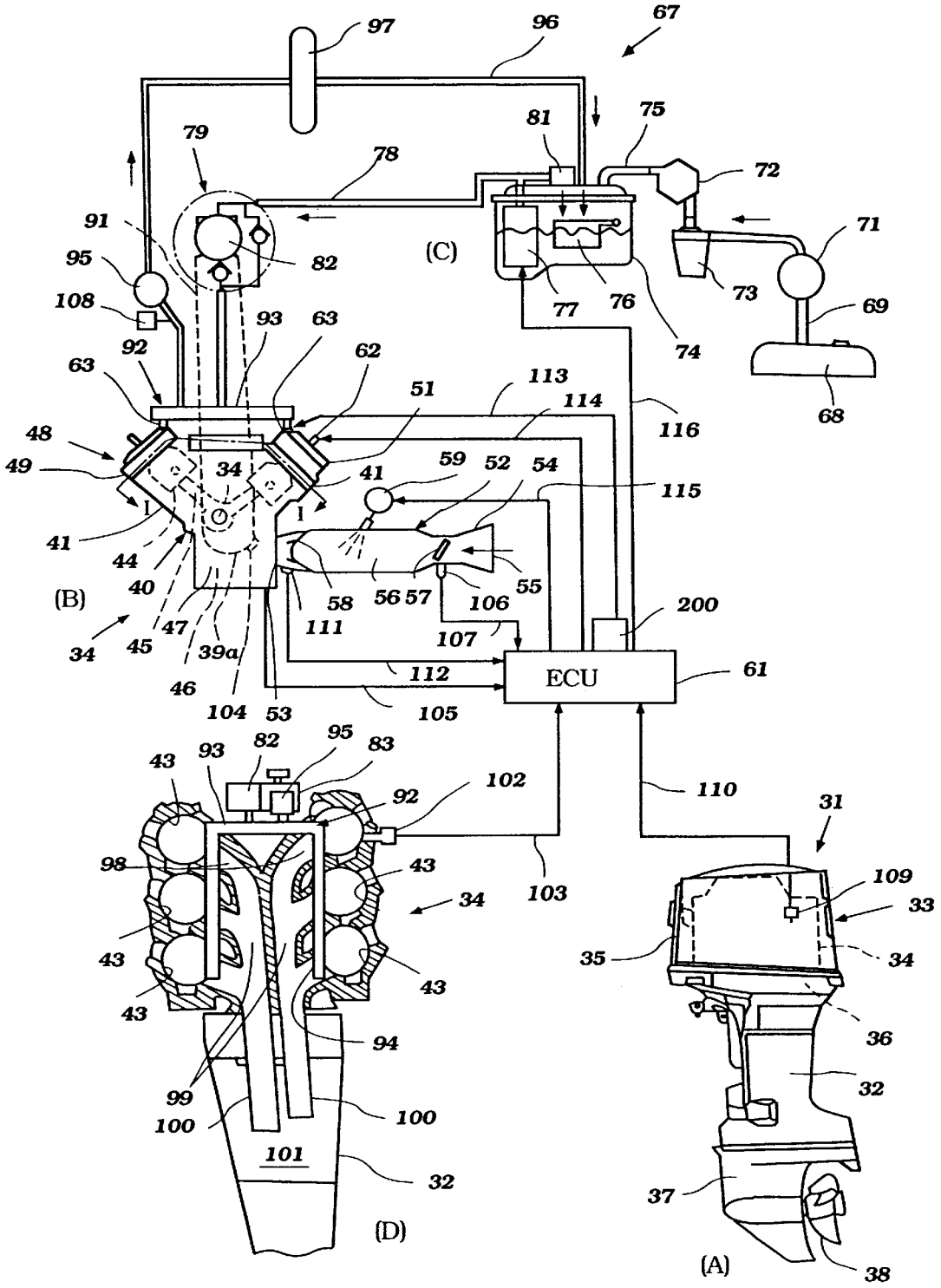
FIG. 1 is a schematic view of an engine control system, which is configured in accordance with a preferred embodiment of the present invention as employed on an outboard motor, and illustrates in section A of the figure the outboard motor from a side elevational view, illustrates in section B and C of the figure a partial schematic view of the engine with associated portions of induction and fuel supply systems, illustrates in section D of the figure a sectional view of the engine (as taken along line I—I of the figure section B) and a drive shaft housing of the outboard motor, and illustrates an electronic control unit of the engine control system communicating with various sensors and controlled components of the engine.

In FIG. 1, section A, an outboard motor constructed and operated in accordance with an embodiment of the invention is depicted in side elevational view and is identified generally by the reference numeral 31.

The entire outboard motor 31 is not depicted in that the swivel bracket and clamping bracket, which are associated with the driveshaft housing, indicated generally by the reference numeral 32, are not illustrated. These components are well known in the art, and thus, the specific method by which the outboard motor 31 is mounted to the transom of an associated watercraft is not necessary to permit those skilled in the art to understand or practice the invention.

The outboard motor 31 includes a power head, indicated generally by the reference numeral 33. The power head 33 is positioned above the driveshaft housing 32 and includes a powering internal combustion engine, indicated generally by the reference numeral 34. The engine 34 is shown in more detail in the remaining two view of this figure and will be described shortly by reference thereto.

The power head 33 is completed by a protective cowling formed by a main cowling member 35 and a lower tray 36. The main cowling member 35 is detachably connected to the lower tray 36. The lower tray 36 encircles an upper portion of the driveshaft housing 32 and a lower end of the engine 34.

Positioned beneath the driveshaft housing 32 is a lower unit 37 in which a propeller 38, which forms the propulsion device for the associated watercraft, is journaled.

As is typical with outboard motor practice, the engine 34 is supported in the power head 33 so that its crankshaft 39 (see section B of FIG. 1) rotates about a vertically extending axis. This is done so as to facilitate connection of the connection of the crankshaft 39 to a driveshaft which depends into the driveshaft housing 32 and which drives the propeller 38 through a conventional forward, neutral, reverse transmission contained in the lower unit 37.

The details of the construction of the outboard motor and the components which are not illustrated may by considered to be conventional or of any type known to those wishing to utilize the invention disclosed herein. Those skilled in the art can readily refer to any known constructions with which to practice the invention.

With reference now in detail to the construction of the engine 34 still by primary reference to FIG. 1, in the illustrated embodiment, the engine 34 is of the V6 type and operates on a two stroke, crankcase compression principle. Although the invention is described in conjunction with an engine having this cylinder number and cylinder configuration, it will be readily apparent that the invention can be utilized with engines having other cylinder numbers and other cylinder configurations. Some features of the invention, however, have particular utility in connection with V-type engines.

Also, although the engine 34 will be described as operating on a two stroke principle, it will also be apparent to those skilled in the art that certain facets of the invention can be employed in conjunction with four stroke engines. In fact, some features of the invention also can be employed with rotary type engines.

The engine 34 is comprised of a cylinder block 40 that is formed with a pair of cylinder banks 41. Each of these cylinder banks is formed with three vertically spaced, horizontally extending cylinder bores 43. Pistons 44 reciprocate in these cylinder bores 43. The pistons 44 are, in turn, connected to the upper or small ends of connecting rods 45. The big ends of these connecting rods are journaled on the throws of the crankshaft 39 in a manner that is well known in this art.

The crankshaft 39 is journaled in a suitable manner for rotation within a crankcase chamber 46 that is formed in part by a crankcase member 47. The crankcase member 47 is affixed to the cylinder block 40 in a suitable manner. As is typical with two cycle engines, the crankshaft 39 and crankcase chamber 46 are formed with seals 39*a* so that each section of the crankcase that is associated with one of the cylinder bores 43 is sealed from the other sections. This type of construction is well known in the art.

A cylinder head assembly, indicated generally by the reference numeral 48, is affixed to an end of each cylinder bank 41 that is spaced from the crankcase chamber 46. As best seen in FIG. 2, these cylinder head assemblies 48 are comprised of a main cylinder head member 49 that defines a plurality of recesses 50 in its lower face. Each of these recesses 50 corporate with the respective cylinder bore 43 and the head of the piston 44 to define the combustion chambers 50*a* of the engine, as is well known in the art. A cylinder head cover member 51 completes the cylinder head assembly 48. The cylinder head members 49, 51 are affixed to each other and to the respective cylinder banks 41 in a suitable, known manner.

With reference again primarily to FIG. 1, an air induction system, indicated generally by the reference numeral 52 is provided for delivering an air charge to the sections of the crankcase chamber 46 associated with each of the cylinder bores 43. This communication is via an intake port 53 formed in the crankcase member 47 and registering with each such crankcase chamber section.

The induction system 52 includes an air silencing and inlet device, shown schematically in this figure and indicated by the reference numeral 54. In actual physical location, this device 54 is contained within the cowling 35 at the forward end thereof and has a rearwardly facing air inlet opening 55 through which air is introduced. Air is admitted into the interior of the cowling 35 in a known manner, and this is primarily through a pair of rearwardly positioned air inlet that have a construction as is generally well known in the art.

The air inlet device 54 supplies the induced air to a plurality of throttle bodies 56, each of which has a throttle valve 57 provided therein. These throttle valves 57 are supported on throttle valve shafts. These throttle valve shafts are linked to each other for simultaneous opening and closing of the throttle valves 57 in a manner that is well known in this art.

As is also typical in two cycle engine practice, the intake ports 53 have, provided in them, reed-type check valves 58. These check valves 58 permit the air to flow into the sections of the crankcase chamber 46 when the pistons 44 are moving upwardly in their respective cylinder bores. However, as the pistons 44 move downwardly, the charge will be compressed in the sections of the crankcase chamber 46. At that time, the reed type check valve 58 will close so as to permit the charge to be compressed. In addition, a lubricant pump 59 is provided for spraying lubricant into the throttle body 56 for engine lubrication under the control of an ECU (Electronic Control Unit) 61 that will be described in greater detail later. Although it is not shown, some forms of direct lubrication also may be employed for delivering lubricant directly to certain components of the engine.

The charge which is compressed in the sections of the crankcase chamber 46 is then transferred to the combustion chamber through a scavenging system (not shown) in a manner that is well known. A spark plug 62 is mounted in the cylinder head assembly 48 for each cylinder bore. The spark plug 62 is fired under the control of the ECU 61. The ECU 61 receives certain signals for controlling the time of firing of the spark plugs 62 in accordance with any desired control strategy.

The spark plug 62 fire a fuel air charge that is formed by mixing fuel directly with the intake air via a fuel injector 63. The fuel injectors 63 are solenoid type injectors and electrically operated. They are mounted directly in the cylinder head 49 in a specific location, as will be described, so as to provide optimum fuel vaporization under all running conditions.

Fuel is supplied to the fuel injectors 63 by a fuel supply system, indicated generally by the reference numeral 67 and which will be described first by reference to FIG. 1, and particularly to sections C and D thereof.

The fuel supply system 67 is composed of a main fuel supply tank 68 that is provided in the hull of the watercraft with which the outboard motor 31 is associated. Fuel is drawn from this tank 68 through a conduit 69 by a first low pressure pump 71 and a plurality of second low pressure pumps 72. The first low pressure pump 71 is a manually operated pump and the second low pressure pumps 72 are diaphragm type pumps operated by variations in pressure in the sections of the crankcase chamber 46, and thus provide a relatively low pressure.

A quick disconnect coupling is provided in the conduit 69 and also a fuel filter 73 is positioned in the conduit 69 at an appropriate location.

From the low pressure pump 72, fuel is supplied to a vapor separator 74 which is mounted on the engine 34 or within the cowling 35 at an appropriate location. This fuel is supplied through a line 75, and a float valve regulates fuel flow through the line 75. The float valve is operated by a float 76, which is disposed within the vapor separator 74, so as to maintain a generally constant level of fuel in the vapor separator 74.

A high pressure electric fuel pump 77 is provided in the vapor separator 74 and pressurizes fuel that is delivered through a fuel supply line 78 to a high pressure pumping apparatus, indicated generally by the reference numeral 79. The electric fuel pump 77, which is driven by an electric motor, develops a pressure such as 3 to 10 kg/cm$^2$. A low pressure regulator 81 is positioned in the line 78 at the vapor separator 74 and limits the pressure that is delivered to the high pressure pumping apparatus 79 by dumping the fuel back to the vapor separator 74.

The high pressure fuel delivery system 79 includes a high pressure fuel pump 82 that can develop a pressure of, for example, 50 to 100 kg/cm$^2$ or more. A pump drive unit 83 (see FIG. 1, section D) is provided for driving the high pressure fuel pump 82. The high pressure fuel pump 82 is mounted on the pump drive unit 83 with bolts.

Figure 2:
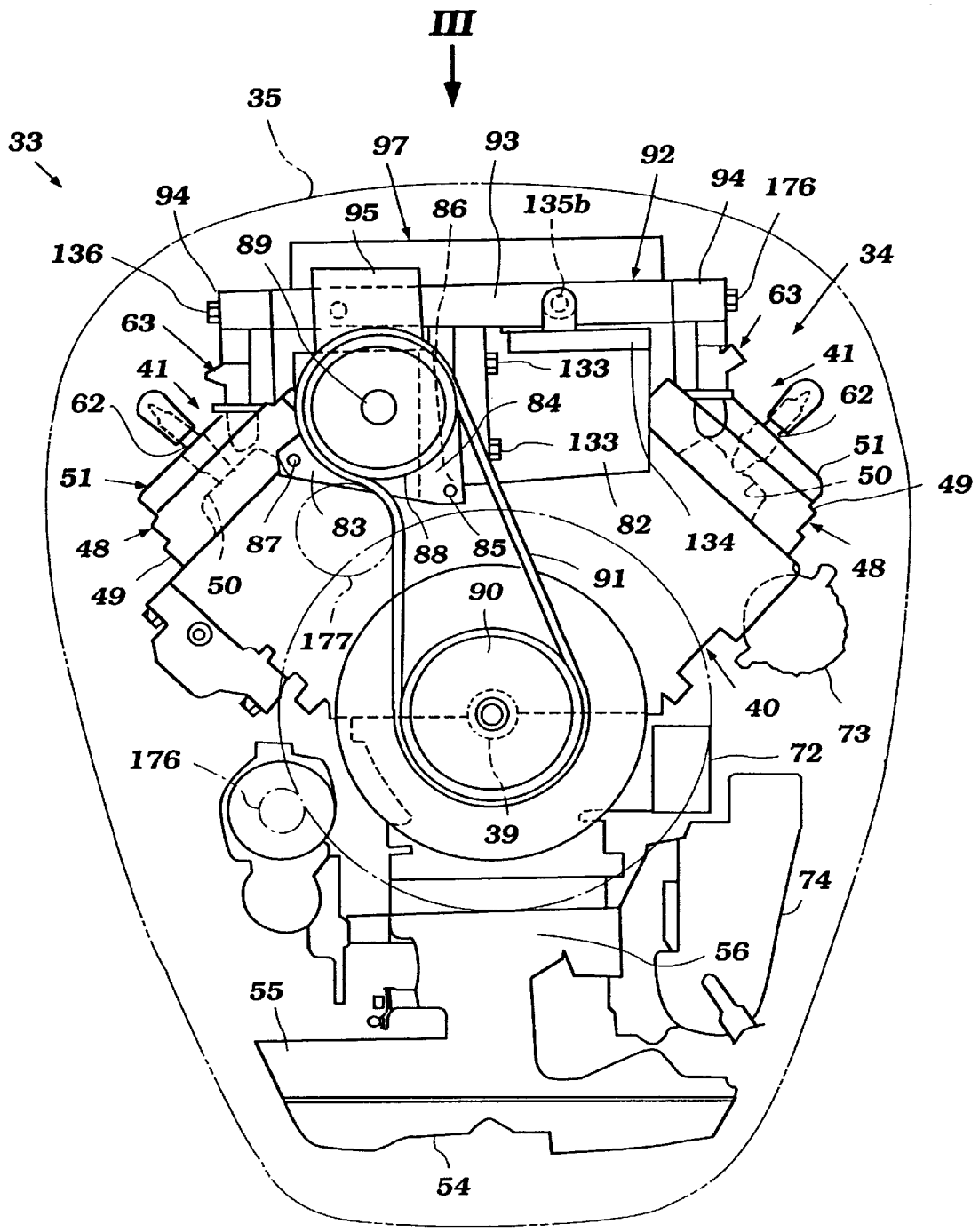
FIG. 2 is a top plan view of a power head of the engine showing the engine in solid lines and the cowling in phantom lines.
Figure 3:
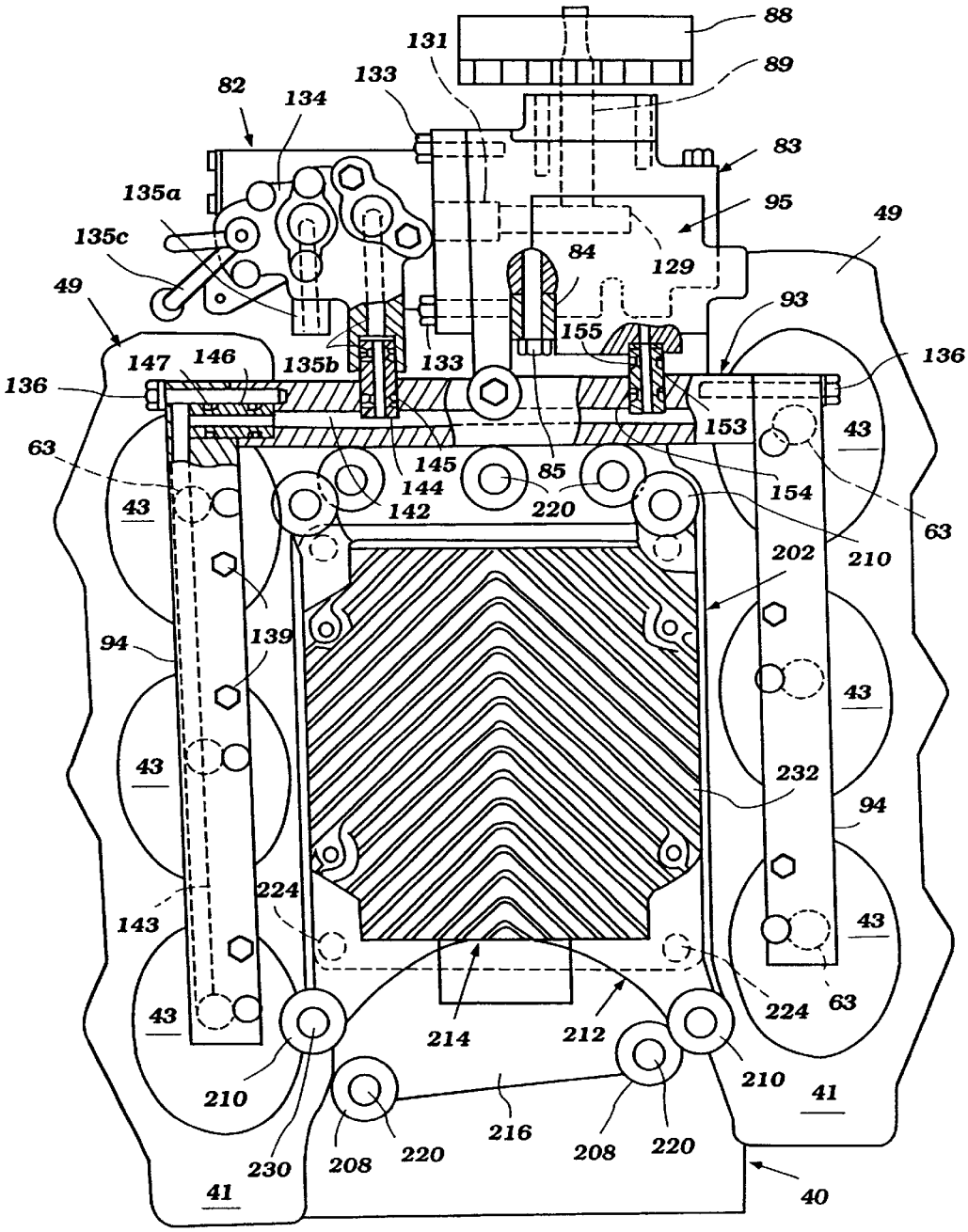
FIG. 3 is a partial sectional, rear elevational view of the engine as viewed in the direction of arrow III of FIG. 2 and illustrates a support for electronics of the engine control system attached to the engine.

With reference to FIGS. 2 and 3, a stay 84 is affixed to the cylinder block 40. The pump drive unit 83 is attached to the stay 84 with bolts 85, 86. The pump drive unit 83 is, further, affixed to the cylinder block 40 directly by bolt 87. The pump drive unit 83 thus overhangs between the two banks 41 of the V-cylinder arrangement. A pulley 88 is affixed to a pump drive shaft 89 of the pump drive unit 83. The pulley 88 is driven by a drive pulley 90 affixed to the crankshaft 39 by means of a drive belt 91 (see FIG. 2). The pump drive shaft 89 is provided with a camdisk extending horizontally for pushing plungers which are disposed on the high pressure fuel pump 82.

Fuel is supplied from the high pressure fuel pump 82 to a fuel supply conduit 92. This fuel supply conduit 92 is comprised of a main fuel manifold 93 that extends horizontally. The main fuel manifold 93, in turn, delivers fuel to a pair of vertically extending fuel rails 94. This construction, connection and the manner of delivery of fuel will be described later by particular reference to FIG. 3. The fuel rails 94 deliver fuel to the fuel injectors 63 in a manner which will be described later by detailed reference also to FIG. 3.

The pressure in the high pressure delivery system 79 is regulated by a high pressure regulator 95 which dumps fuel back to the vapor separator 74 through a pressure relief line 96 in which a fuel heat exchanger or cooler 97 is provided.

After the fuel charge has been formed in the combustion chamber by the injection of fuel from the fuel injectors 63, the charge is fired by firing the spark plugs 62. The injection timing and duration, as well as the control for the timing of firing of the spark plugs 62, are controlled by the ECU 61.

Once the charge burns and expands, the pistons 44 will be driven downwardly in the cylinder bores until the pistons 44 reach the lowermost position. At this time, an exhaust port (not shown) will be uncovered so as to open the communication with an exhaust passage 98 (see the lower left-hand view) formed in the cylinder block 40.

The exhaust gases flow through the exhaust passages 98 to collector sections 99 of respective exhaust manifolds that are formed within the cylinder block 40. These exhaust manifold collector sections 99 communicate with exhaust passages formed in an exhaust guide plate on which the engine 34 is mounted.

A pair of exhaust pipes 100 depends from the exhaust guide plate and extend the exhaust passages 98 into an expansion chamber 101 formed in the driveshaft housing 32. From this expansion chamber 101, the exhaust gases are discharged to the atmosphere through a suitable exhaust system. As is well known in outboard motor practice, this may include an underwater, high speed exhaust gas discharge and an above the water, low speed exhaust gas discharge. Since these types of systems are well known in the art, a further description of them is not believed to be necessary to permit those skilled in the art to practice the invention.

Any type of desired control strategy can be employed for controlling the time and duration of fuel injection from the injector 63 and timing of firing of the spark plug 62; however, a general discussion of some engine conditions that may be sensed and some other ambient conditions that can be sensed for engine control will follow. It is to be understood, however, that those skilled in the art will readily understand how various control strategies can be employed in conjunction with the components of the invention.

The control for the fuel air ratio preferably includes a feed back control system. Thus, a combustion condition or oxygen sensor 102 is provided that senses the in-cylinder combustion conditions by sensing the residual amount of oxygen in the combustion products at a time near the time when the exhaust port is opened. This output signal is carried by line 103 to the ECU 61, as schematically illustrated in FIG. 1.

There also is provided a crank angle position sensor 103 associated with the crankshaft 39 which when measuring crank angle versus time and output an engine speed signal to the ECU 61 via line 105, as schematically indicated. Engine load, as determined by throttle angle of the throttle valve 57, is sensed by a throttle position sensor 106 which outputs a throttle position or load signal to the ECU 61 via line 107.

There is also provided a pressure sensor 108 communicating with the fuel line connected to the pressure regulator 95. This pressure sensor 108 outputs the high pressure fuel signal to the ECU 61 (signal line is omitted).

There also may be provided a water temperature sensor 109 (see the lower right-hand view) which outputs a cooling water temperature signal to the ECU 61 via signal line 110.

Further, an intake air temperature sensor 111 (see the upper view) is provided and this sensor 111 outputs an intake air temperature signal to the ECU 61 via signal line 112.

The sensed conditions are merely some of those conditions which may be sensed for engine control and it is, of course, practicable to provide other sensors such as, for example, but without limitation, an engine height sensor, a trim angle sensor, a knock sensor, a neutral sensor, a watercraft pitch sensor and an atmospheric temperature sensor in accordance with various control strategies.

The ECU 61, as has been noted, outputs signals to the fuel injector 63, spark plug 62, the lubrication pump 59 and the high pressure electric fuel pump 77 for their respective control. These control signals are caused by respective control lines which are indicated schematically in FIG. 1 at 113, 114, 115 and 116, respectively.

With reference now to FIGS. 2 and 3, a construction, connection and mounting structure of the aforenoted components including the high pressure pumping apparatus 79, the fuel supply conduit 93 and the high pressure regulator 95 will be described in more detail.

FIG. 2 is a top plan view of the power head 33 accommodating the engine 34 showing the engine 34 in solid lines and the cowling 35 in phantom. FIG. 3 is a rear elevational view of the engine 34 showing partly in cross-section and is taken generally in the direction of arrow III in FIG. 2.

The driving pulley 90 in the pump drive unit 84 of the high pressure pumping apparatus 79 is mounted on the crankshaft 39, while the driven pulley 88 is mounted on the pump drive shaft 89 of the pump drive unit 83. The driving pulley 90 drives the driven pulley 88 by means of the drive belt 91. The high pressure pump 82 is mounted on either side of the pump drive unit 83 and is driven by the drive unit 83 in a manner described above.

The stay 84 is affixed to the cylinder body 40 with bolts so as to extend from the cylinder body 40 and between both cylinder banks 41. The pump drive unit 83 is then partly affixed to the stay 84 with bolts 85, 86, 87 and partly directly affixed to a boss of the cylinder body 40 so that the pump drive unit 83 is mounted on the cylinder body 40 as overhanging between the two banks 41 of the V arrangement.

The rotational shaft 89 of the pump drive unit 83 has a cam disc 129 existing horizontally. The cam disc 129 is provided for pushing a plunger 131 which is disposed on the high pressure pump 82.

The high pressure pump 82 is mounted on the pump drive unit 83 with bolts 133 at both sides of the pump drive unit 83. In this regard, a diameter of the bolt receiving openings on the pump drive unit 83 is slightly larger than a diameter of the bolts 133. Thus, the mounting condition of the high pressure pump 82 on the pump drive unit 83 is adjustable within a gap made between the opening and the bolt 133. The respective high pressure pump 82 has a unified fuel inlet and outlet module 134 which is mounted on a side wall of the pressure pump 82. As best seen in FIG. 3, the inlet and outlet module 134 has an inlet passage 135*a* connected with the line 78 (FIG. 1), an outlet passage 135*b* connected with the fuel supply conduit 92 and an overflow passage 135*c* connected with the vapor separator 74 (FIG. 1). The line for returning the overflow fuel to the vapor separator 74 is omitted in FIG. 1.

The fuel supply conduit 92 is comprised of the main manifold 93 and the pair of fuel rails 94 depending from both ends of the main manifold 89. The fuel rails 94 are affixed to the main manifold 93 with bolts 136. The respective fuel rails 94 are affixed to both of the cylinder heads 48 with bolts 139. The bolts 139 are placed in the proximity to the fuel injectors 63. Other bolts may of course be provided, for instance, at the middle positions of two fuel injectors 63 in addition to the bolts 139. Thus, the fuel supply conduit 92 is mounted on the engine 34 by means of the pump drive unit 83 via the stay 84, partly directly, at the cylinder body 40 and by means of fuel rails 94 at the cylinder head 48. The connecting structure of the fuel rails 94 with the cylinder head 48 will be described more in detail later.

The main manifold 93 and the fuel rails 94 are hollow conduits and hollows therein form fuel passages 142 and 143. The fuel passage 142 in the main manifold 93 and the fuel passages 143 in both of the fuel rails 94 are connected together. The outlet passage 135*b* of the fuel inlet and outlet module 134 is connected to the fuel passage 142 of the main manifold 93 with connectors 144 around which are sealed with O-shaped elastic (rubber) rings 145. The main manifold 93 and the fuel rails 94, in turn, are connected with connectors 146 around which are sealed with the same O-shaped elastic rings 147.

The pressure regulator 95 is also mounted on the pump drive unit 83. The pressure regulator 90 has a passage 152 therein that forms a part of the pressure relief line 91 (FIG. 1) and this passage 152 is connected with the fuel passage 142 in the main manifold 88 with a connector 153 around which is also sealed with an O-shaped elastic (rubber) ring 154.

The fuel injectors 63 are provided between the fuel rails 94 and the cylinder head 48 in the following manner. Horseshoe shaped spacers are disposed between flanges formed around the fuel injectors 63 and the fuel rails 94. The rear ends of the fuel injectors 63 are placed in small chambers with O-shaped elastic (rubber) rings. The small chambers are connected to the fuel passage 143. The spacers are affixed to the fuel rails 94 with bolts and the fuel injectors 63 are affixed to the fuel rails 94 by means of the connections. It is desirable to dispose the bolts as close to the fuel injectors 63 as possible for secure fixing of the fuel injectors 63.

The fuel injectors 63 are inserted into openings that are provided on the cylinder head 48 so that nozzles of the fuel injectors 63 face onto the combustion chambers. The opening is larger than the diameter of a fuel injector portion that is placed in the opening so that the positioning of the fuel injector 63 in the opening is adjustable. More specifically, there is a gap between the opening and the portion of the fuel injector 63. A seal member which is made of metal, such as a disc spring, is provided between a shoulder of the fuel injector 63 and a step formed in the opening to have the shoulder seated. A metal seal member 171 is used for sealing here because the combustion gases have an extremely high pressure and high temperature.

The fuel rails 94 are fixed to bosses formed on the outer surface of the both cylinder heads 48 with the bolts 139. The sub-assembled unit including the fuel supply conduit 87, the high pressure pumping apparatus 79 (the high pressure pump 82 and the pump drive unit 83), pressure regulator 95 and the fuel injectors 63 forms a high pressure fuel injection unit.

In addition, as best seen in FIG. 2, a starter motor 176 for starting the engine 34 and a tensioner 177 for giving tension to the belt 86 are provided.

An assembling process will be described hereunder. The stay 84 first is fixed to the cylinder body 40. Next, the main manifold 93 and both of the fuel rails 94 are jointed and further the fuel injectors 63 are fixed to the fuel rails so that the fuel supply conduit 87 is completed. The pump drive unit 83 onto which the high pressure pump 82 and the pressure regulator 95 are already mounted is fixed to the fuel supply conduit 87. Then, the connectors 144, which project from the inlet and outlet module 134 attached to the high pressure pump 82, are connected to the fuel passage 142 of the main manifold 93. Also, the connector 153, which projects from the pressure regulator 95, is connected to the fuel passage 142. Thus, the high pressure fuel injection unit is completed.

The fuel injectors 63 are then inserted into the openings of the cylinder heads 49 and the fuel rails 94 are temporarily fixed to the cylinder heads 49. Meanwhile, the pump drive unit 83 is also temporarily fixed to the cylinder body 40, partly via the stay 84 and partly directly.

In conventional mounting and affixing processes, generally, the fuel injectors 63 are not easily placed in the desired positions due to accumulated tolerances. As described above, however, in this embodiment, there is a gap between the fuel injectors 63 and the opening and also between the bolt 133 and bolt receiving openings formed on the pump drive unit 83 made by the diameter differences thereof. Accordingly, the fuel injectors 63 are easily positioned as desired. Finally, the high pressure fuel injection unit is fully fixed to the engine 34. By this final fixing, the metal seal members placed around the nozzles of the fuel injectors 63 are pressed to both of the shoulder portions of the fuel injectors 63 and the step portions of the openings so as to securely prevent combustion gases from leaking through the openings.

With reference to FIG. 1, the ECU 61 controls the timing and the duration of fuel injection. The ECU 61 thus controls the opening and closing of the solenoid valves of the fuel injectors 63, and in particular, controls the selective supply of current to the solenoids of the fuel injectors 63. In order to drive the solenoids of the fuel injectors 63 in a direct injection fuel system, the engine control system includes one or more injector drivers 200. The ECU 61 selectively places the injector drivers 200 in communication with the solenoids of the fuel injectors 63 to operate the fuel injectors 63.

The ECU 61 and the injector drivers 200 desirably are mounted to the engine 34 in order to present a compact arrangement within the cowling so as to minimize the size of the power head 33 (which usually projects above a transom of an associated watercraft). A support 202 attaches at least the injector drivers 200 to the engine 34, and desirably also attaches the ECU 61 to the engine 34.

The support 202 includes a first vibration-damping layer 204 to absorb high frequency vibrations or vibratory forces produced by the engine 34, especially when operating at high speeds, e.g., above 5300 rpm. In one mode, the first layer 204 is disposed between the engine 34 and the ECU 61, and between the engine 34 and the injector drivers 200.

The support 202 also includes at least a second vibration-damping layer 206 to absorb lower frequency vibrations or vibratory forces produced by the ECU 61. The second layer 206 is disposed between the ECU 61 and other electronic components. In the illustrated embodiment, the second layer 206 is arranged between the ECU 61 and the injector drivers 200.

Both the first and second layers 204, 206 of materials can be formed of a single continuous layer of material or can be formed by multiple pieces that together form a "layer." For instance, in the illustrated embodiment, each layer 204, 206 is formed by a plurality of grommets 208, 210, respectively. Each grommet 208, 210 on a particular layer 204, 206 is formed of either the same material or of a material having generally the same vibration-damping characteristics. The grommets 208 that form the first layer 204 are harder than the grommets 210 that form the second layer 206 so as to dampen higher frequency vibrations or vibratory forces produced by the engine 34. The grommets 210 that form the second layer 206 are formed of a softer material to absorb lower frequency vibrations or vibratory forces produced by electrical components (e.g., the ECU 61).

Figure 4:
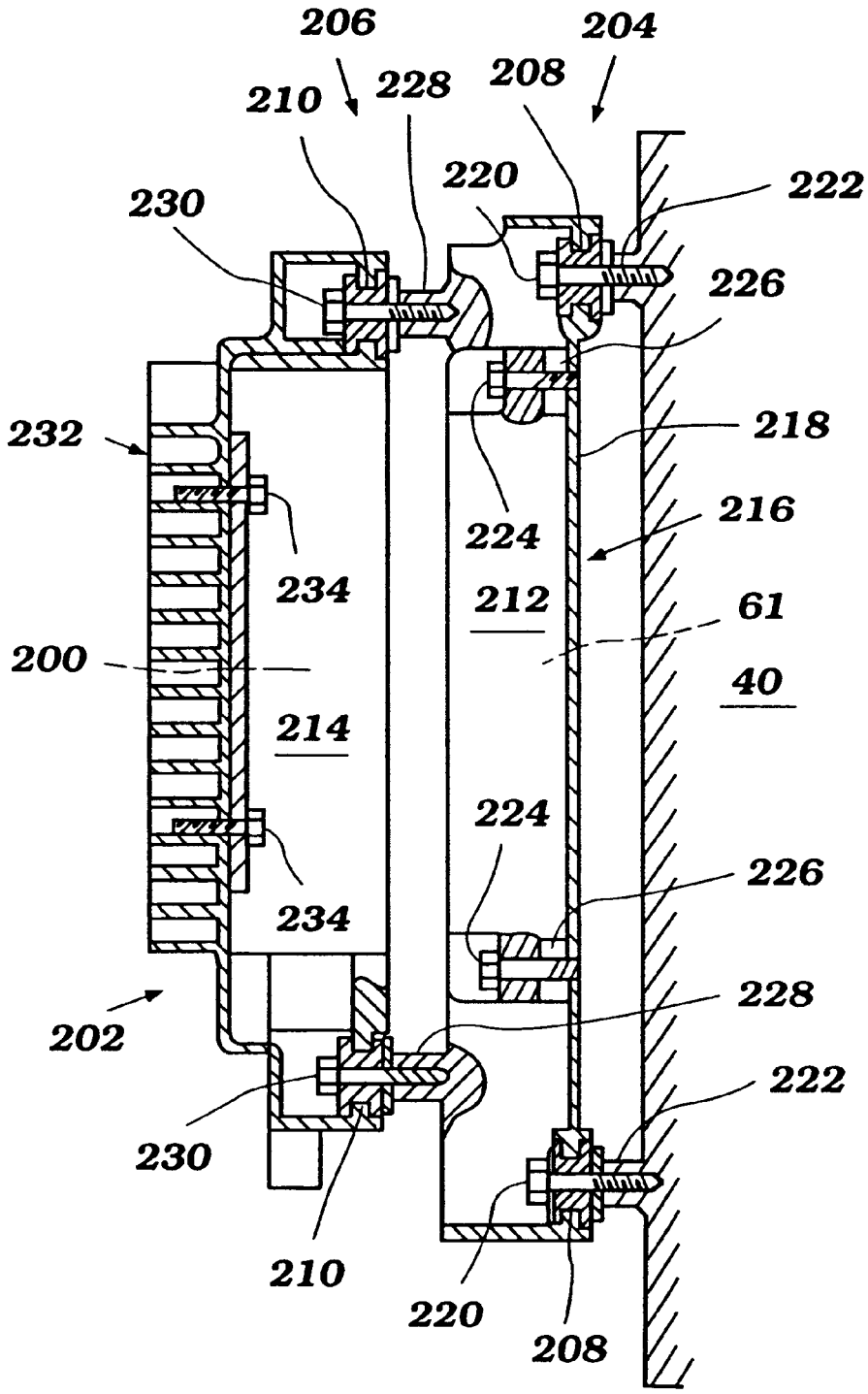
FIG. 4 is a cross-sectional view of the electronic support taken along line 3—3 of FIG. 4.

In the illustrated embodiment, as seen in FIGS. 3 and 4, the ECU 61 is disposed within an ECU box 212 and the injector drivers 200 are disposed within an injector driver box 214. Each of these components 61, 200 preferably includes electronic components mounted on a substrate. These components, as well as the substrate, desirably are potted within their respective boxes 212, 214. Of course, each box 212, 214 itself can also serve as the substrate.

The support 202 includes a mounting member 216 including a plurality of mounting holes passing through a base 218. Grommets 208, which are formed of a first material so as to form the first layer 204, are disposed within the mounting holes. Mounting bolts 220 pass through the grommets 208 and cooperate with threaded holes formed in corresponding bosses 222 that are arranged on the engine 34. As understood from FIG. 3, these bosses 222 are formed on either the cylinder block 40 (as illustrated) or the cylinder heads 49 at locations within a valley between the cylinder banks 41. The grommets 208 of the first layer 204 isolate the mounting member 216 from the bosses 222 and from the bolts 220. That is, a portion of each grommet 208 is disposed between the mounting member 216 and the bolt 220 and between the mounting member 216 and the engine 34.

The ECU box 212 is attached to the mounting member 216 by bolts 224. The bolts 224 cooperate with a first set of bosses 226 that project from the base 218. Each boss 226 includes a threaded hole that receive the bolt 224. A portion of the ECU box 212 is interposed between a head of the bolt 224 and an corresponding boss 226 to attach the ECU box 212 to the mounting member 216.

The mounting member 216 additionally includes a second set of bosses 228 that project from the base 218. The second set of bosses 228 project beyond the first set 226 and support the injector driver box 214. For this purpose, the injector driver box 214 includes a plurality of mounting holes. Grommets 210, which are formed of a second material so as to form the second layer 206, are disposed within the mounting holes. Mounting bolts 230 pass through the grommets 210 and cooperate with threaded holes formed in corresponding bosses 228 of the mounting member 216. As understood from FIG. 3, the injector driver box 214 is also arranged between the cylinder banks 41 of the engine 34 to reduce the girth of the engine 34. The grommets 210 of the second layer 206 substantially isolate the injector driver box 214 from the bosses 228 of the mounting member 216 and from the bolts 230. That is, a portion of each grommet 210 is disposed between the injector driver box 214 and the bolt 230 and between the injector driver box 214 and the mounting member boss 228.

The support 202 formed by the mounting member 216 and the first and second vibration damping layers 204, 206 attaches the injector driver box 214 to the engine 34, while generally decoupling the injector driver box 214 (and the injector drivers 200 within the box 214) from vibrations and vibratory forces produced by the engine 34, as well as by the ECU 61. This effect is achieved by using material having different spring constants for the first and second layers 204, 206. In one mode, the first layer 204 of damping material is made of a hard material (e.g., a hard rubber) so as to reduce high frequency vibrations or vibratory forces coming from the engine 34 (e.g., vibratory forces on the order of 30 G). The second layer 206 of damping material is made of a softer material than the first layer so as to absorb relatively low frequency vibrations or vibratory forces coming from the ECU box 212 (e.g., vibratory forces on the order to 8 G).

Figure 5:
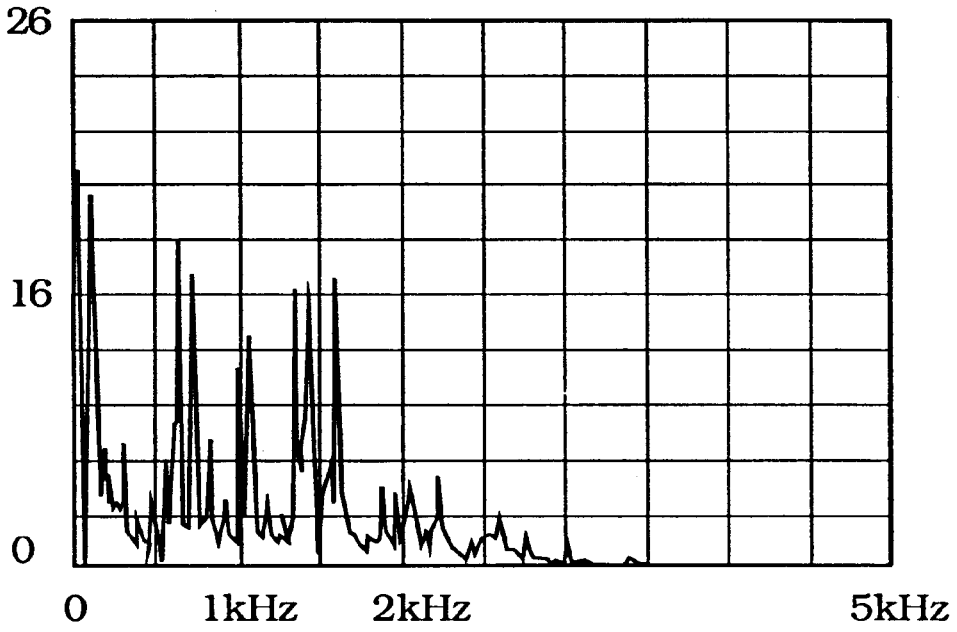
FIG. 5 is a graph of test results of electronics mounted onto an engine by the present vibration-damping support, and illustrates a relationship between various frequencies and the forces experienced by the supported electronics when measured under a maximum engine speed (e.g., 5330 rpm).

FIG. 5 illustrates the test results of the vibratory forces sensed on the injector driver box 214 as employed on an engine that was constructed in accordance with the present description and was operated under a wide-open running condition at a speed of 5330 rpm (which created resonant vibration). The detected vibratory forces on the box were about 1 G (more specifically less than 1.3 G) over a range of frequencies. The vibrations for specific frequencies can be effectively reduced by appropriate selection and combination of damping materials. Thus, the multi-layer damping structure substantially isolates the injector driver box from the vibratory forces produced by the ECU and by the engine.

With reference to FIGS. 3 and 4, a cooling fin structure 232 desirably is attached to the injector driver box 214 by a plurality of bolts 234. The cooling fin structure 233 includes a plurality of cooling fins. Each fin desirably slopes obliquely relative to an axis of the crankshaft 39. In the present outboard motor embodiment, the fins slope downward and obliquely relative to the crankshaft axis so as to prevent water from collecting between the fins. In the illustrated embodiment, the fins slope downward from a vertical center line of the structure to produce an inverted V-shaped pattern.

Although this invention has been described in terms of a certain preferred embodiment, other embodiments apparent to those of ordinary skill in the art are also within the scope of this invention. For instance, it is understood that the first and second layers of the support can be formed as a unitary piece as oppose to separate pieces shown and described in the illustrated embodiment. It is also understood that the support can include more than two vibration damping layers and can be readily tailored by one skilled in the art to isolate the subject electrical component(s) (or for that matter any type of vibration sensitive component) from various frequencies and vibratory forces. Accordingly, the scope of the invention is intended to be defined only by the claims that follow.

What is claimed is:

1. An engine comprising an engine body defining at least one variable-volume combustion chamber, at least one fuel injector communicating with the combustion chamber, an electronic control system communicating with the fuel injector, the electronic control system including at least one electronic component disposed upon a substrate, and a multi-layer support coupling the substrate to the engine, at least two of the layers of the multi-layer support having differing vibration damping effects.

2. An engine as in claim 1, wherein the at least two layers of the support are disposed apart from each other.

3. An engine as in claim 1 additionally comprising a housing containing the substrate.

4. An engine as in claim 3 additionally comprising a mounting member affixed to the engine through one layer of the at least two layers of the multi-layer support, and the housing being attached to the mounting member through the other layer of the at least two layers of the support.

5. An engine as in claim 1, wherein the at least two layers of the multi-layer support have different spring constants from each other.

6. An engine as in claim 1, wherein the at least two layers of the multi-layer support have different hardnesses from each other.

7. An engine as in claim 1 additionally comprising a crankshaft, and the engine body being arranged such that the crankshaft rotates about a generally vertically oriented axis.

8. An engine as in claim 1, wherein the engine body has a V-type configuration formed by two banks of cylinders, each cylinder defines, at least in part, a corresponding variable-volume combustion chamber, and the substrate is attached to the engine at a location within a valley between the banks of cylinders.

9. An engine as in claim 8 further comprising additional fuel injectors, at least one fuel injector communicating directly with a corresponding combustion chamber, and a pair of fuel rails, each fuel rail communicating with corresponding fuel injectors along a respective bank of cylinders, and the substrate being disposed between the fuel rails.

10. An engine as in claim 1 additionally comprising a housing containing the injector driver, the housing including a plurality of cooling fins.

11. An engine as in claim 10, wherein the fins are disposed on the housing so as to slope downwardly.

12. An engine comprising an engine body defining at least one variable-volume combustion chamber, at least one fuel injector communicating with the combustion chamber, an electronic control system communicating with the fuel injector, the electronic control system including at least one electronic component disposed upon a substrate, and a multi-layer support coupling the substrate to the engine, a first dampener being arranged between the engine and a first layer of the multi-layer support, and a second dampener being arranged between the first layer and a second layer of the multi-layer support.

13. An engine as in claim 12, wherein the electronic control system additionally includes an electronic control unit supported on the engine by the second layer.

14. An engine as in claim 13, wherein the first dampener is harder than the second dampener.

15. An engine as in claim 13, wherein the first dampener has a different spring constant than the second dampener.

16. An engine as in claim 12, wherein each dampener comprises a plurality of grommets formed of the same material.

17. An engine as in claim 12 additionally comprising a crankshaft, and the engine body being arranged such that the crankshaft rotates about a generally vertically oriented axis.

18. An engine as in claim 12, wherein the engine body has a V-type configuration formed by two banks of cylinders, each cylinder defines, at least in part, a corresponding variable-volume combustion chamber, and the substrate is attached to the engine at a location within a valley between the banks of cylinders.

19. An engine as in claim 18 further comprising additional fuel injectors, at least one fuel injector communicating directly with a corresponding combustion chamber, and a pair of fuel rails, each fuel rail communicating with corresponding fuel injectors along a respective bank of cylinders, and the substrate being disposed between the fuel rails.

20. An engine as in claim 12 additionally comprising a housing containing the injector driver, the housing including a plurality of cooling fins.

21. An engine as in claim 20, wherein the fins are disposed on the housing so as to slope downwardly.

22. An internal combustion engine comprising an engine body defining at least one variable-volume combustion chamber, at least one fuel injector communicating directly with the combustion chamber, an electronic control system communicating with the fuel injector, the electronic control system including an electronic control unit and at least one injector driver disposed upon a substrate which is attached to the engine, and means for substantially isolating the injector driver from vibrations produced by the electronic control unit and from vibrations produced by the engine.

23. An engine as in claim 22 in combination with a cowling assembly of an outboard motor, the cowling assembly including a removable cowling member and a lower tray to which the cowling member is releasably attached.

24. An engine as in claim 22, wherein the electronic control unit is disposed between the engine and the substrate.

25. An engine as in claim 22 additionally comprising a crankshaft, and the engine body being arranged such that the crankshaft rotates about a generally vertically oriented axis.

26. An engine as in claim 22, wherein the engine body has a V-type configuration formed by two banks of cylinders, each cylinder defines, at least in part, a corresponding variable-volume combustion chamber, and the substrate is attached to the engine at a location within a valley between the banks of cylinders.

27. An engine as in claim 26 further comprising additional fuel injectors, at least one fuel injector communicating directly with a corresponding combustion chamber, and a pair of fuel rails, each fuel rail communicating with corresponding fuel injectors along a respective bank of cylinders, and the substrate being disposed between the fuel rails.

28. An engine as in claim 22 additionally comprising a housing containing the injector driver, the housing including a plurality of cooling fins.

29. An internal combustion engine comprising an engine body defining at least one variable-volume combustion chamber, at least one fuel injector communicating with the combustion chamber, an electronic control system communicating with the fuel injector, the electronic control system including a first electronic component and a second electronic component, and an electrical component support structure mounted to the engine and comprising a first substrate and a second substrate, the first electronic component being disposed on the first substrate and the second electronic component being disposed on the second substrate, a dampener being disposed between the first and second substrates.

30. The internal combustion engine of claim 29, wherein the dampener is adapted to substantially isolate the second electronic component from vibrations produced by the first electronic component.

31. The internal combustion engine of claim 29, wherein a second dampener is provided between the first and second substrates and the engine, and the second dampener is adapted to substantially isolate the first and second electronic components from vibrations produced by the engine.

32. The internal combustion engine of claim 29, wherein the second electronic component comprises an injector driver.

33. The internal combustion engine of claim 32, wherein the first electronic component comprises an electronic control unit.

34. The internal combustion engine of claim 33, wherein a second dampener is provided between the first and second substrates and the engine.

35. The internal combustion engine of claim 34, wherein the first dampener is adapted to substantially isolate the second electronic component from vibrations produced by the first electronic component, and the second dampener is adapted to substantially isolate the first and second electronic components from vibrations produced by the engine.

36. The internal combustion engine of claim 34, wherein the dampeners comprise grommets.

37. The internal combustion engine of claim 34, wherein the first dampener has a different hardness than the second dampener.

38. The internal combustion engine of claim 34, wherein the first dampener has a different spring constant than the second dampener.

* * * * *